United States Patent [19]

Cramer

[11] Patent Number: 4,848,089

[45] Date of Patent: Jul. 18, 1989

[54] COMBUSTOR ATTACHMENT DEVICE

[75] Inventor: Paul S. Cramer, Naugatuck, Conn.

[73] Assignee: Avco Corporation, Providence, R.I.

[21] Appl. No.: 157,989

[22] Filed: Feb. 18, 1988

[51] Int. Cl.[4] ..... F23R 3/20

[52] U.S. Cl. ..... 60/752; 60/39.32; 24/573; 411/525

[58] Field of Search ..... 60/39.31, 39.32, 722, 60/752, 753, 755-760; 24/573, 453, 543, 544, 563, 571, 501, 511, 520, 658, DIG. 9, 295; 411/521, 522, 523, 525, 526, 528; 248/509

[56] References Cited

U.S. PATENT DOCUMENTS

| | | | |
|---|---|---|---|
| 2,230,916 | 2/1941 | Tinnerman | 411/525 |
| 2,310,756 | 2/1943 | Tinnerman | 411/525 |
| 2,651,912 | 9/1953 | Abbott | 60/755 |
| 3,182,367 | 5/1965 | Hamann et al. | 411/522 |
| 3,606,406 | 11/1969 | Walters | 287/20 |
| 4,413,493 | 11/1983 | Meinsen et al. | 411/525 |
| 4,471,623 | 9/1984 | Griffin | 60/752 |
| 4,512,159 | 4/1985 | Memmen | 60/39.32 |
| 4,748,806 | 6/1988 | Drobny | 60/752 |

FOREIGN PATENT DOCUMENTS

| | | | |
|---|---|---|---|
| 529317 | 11/1940 | United Kingdom | 411/523 |
| 1487064 | 9/1977 | United Kingdom | 60/39.32 |

*Primary Examiner*—Carlton R. Croyle
*Assistant Examiner*—Timothy S. Thorpe
*Attorney, Agent, or Firm*—Perman & Green

[57] ABSTRACT

A segmented combustor wall panel for a gas turbine engine is retained by a clip secured to a post extending radially from the segmented panel. This post passes through a hole in the outer wall support structure and is machined to have a square cross section at a region spaced from its end. A double looped spring clip composed of spring sheet metal is received on the post and has its free opposed ends provided with cutouts to conform to the shape of the square cross section portion of the post to thereby prevent rotation of the clip on the post. The double looped arrangement of the clip provides a fail safe feature in that the clip will retain the post even in the event half the clip should fail.

4 Claims, 1 Drawing Sheet

COMBUSTOR ATTACHMENT DEVICE

BACKGROUND OF THE INVENTION

1. Field of the Invention

This invention relates generally to rapid attachment devices and, more particularly, to such devices for securing the floating wall panels to the outer shell of the combustor liner for a gas turbine type power plant.

2. Description of the Prior Art

A preferred combustion liner construction for gas turbine engines utilize a floating combustor wall which comprises an outer shell which may be formed in a complete hoop or segmented and has attached thereto a plurality of free floating segments that are adapted to be displaced axially and circumferentially in response to the thermals of the system. Such designs are capable of withstanding the hostile environment to which they are subjected with an improved durability characteristic. However, a problem which has persisted in the floating combustor wall design concerns the attachment of the floating wall segments to the outer shell. According to one technique used heretofore, a hook is formed integral with the segmented floating wall panel that passes through an aperture in the outer shell holding strap is then attached to hold the hook in place. Unfortunately, such a system is relatively complex and expensive to fabricate, assemble and maintain.

Other typical constructions are disclosed in U.S. Pat. Nos. 4,471,623 and 4,512,159. A drawback of the former resides in the requirement to weld retention plates once they have been properly positioned. A drawback of the latter resides in the two step attachment process according to which the spring clip must first be positioned over the post and moved radially onto the post, then slipped laterally into holding engagement with the post. Another drawback of the latter device resides in the fact that a failure of one of the two retaining legs thereof will cause the entire attachment mechanism to fail.

While the attachment devices of the prior art as described above have been generally satisfactory in the performance of their intended functions, a need continues to exist for an attachment arrangement which can even more quickly and assuredly be attached at minimal cost and which can perform even in the event of a partial disability.

SUMMARY OF THE INVENTION

The broad object of this invention is to provide for the combustor of a turbine type power plant an improved retention means for floating wall segmented panels. One feature of the invention is that a spring clip fits an integral post formed on the floating wall panel and spring loads the panel to the outer shell while allowing axial and circumferential movement relative to each other. Another feature of this invention is that the spring clip is designed to prevent itself from becoming dislodged as is the case of heretofore known spring clips. Another feature of this invention is the mutual design of the post and clip which prevent rotation of the clip and facilitates the insertion of the clip.

Another feature is an improved spring clip retention which is characterized as being relatively inexpensive and retains the installed parts in a positive manner.

Yet another, and particularly notable, feature resides in the fail safe construction of the clip by reason of which it can continue to perform in the event it is partially disabled.

The invention contemplates attaching the floating wall panels by a spring clip adapted to fit onto an integral post so as to preload the panel in a radial direction. Because this is virtually the only load on the spring clip notwithstanding the high temperature environment, such a retention system is highly durable, improving the maintainability of the combustor liner. Since the clip is removable without damage to the post, the removal of panels is facilitated which enhances the maintainability of the combustor.

Another aspect of this invention is a novel clip design adapted to secure a removable assembly with the clip which is snapped onto a cooperating post. The clip is characterized by being self-retaining with protection against inadvertent dislodging and capable of imparting a radial load to the assembled parts.

According to the invention, the post has a round cross section and a peripheral outer surface and is formed with a square cross section region defined between opposed shoulders at a location spaced from an extreme end thereof, the square cross section region further defining four sidewalls lying in a chordal plane and corner edges at the intersection of each pair of said sidewalls which are substantially coextensive with the outer surface of said post. The clip is elongated and is composed of spring sheet material, such as spring steel. it has opposed ends and a centrally disposed hole which is equidistant from its ends for reception on the post. The ends are formed with diamond shaped cutouts to conform with said corner edges of the square cross section region of the post, and the ends are proximally opposed to one another so as to generally overlie the hole in the clip. In this manner, the cutouts are positioned to engage the corner edges of the square cross section region of the post. Additionally, the clip has opposed loop portions on opposite sides of the hole which are engageable with the outer shell. Thus, when the clip is received on the post and the cutouts engage the corner edges, the clip is effective to retain and bias the segmented member and the shell together. Furthermore, the clip is thereby oriented in a given position and is positively prevented from becoming dislodged by relative axial movement of the segmented member and the shell.

Other and further features, objects, advantages, and benefits of the invention will become apparent from the following description taken in conjunction with the following drawings. It is to be understood that both the foregoing general description and the following detailed description are exemplary and explanatory but not restrictive of the invention. The accompanying drawings which are incorporated in, and constitute a part of this invention, illustrate some of the embodiments of the invention and, together with the description, serve to explain the principles of the invention in general terms. Like numerals refer to like parts throughout.

DETAILED DESCRIPTION OF THE PREFERRED EMBODIMENT

While this invention in its preferred embodiment constitutes an improvement on the floating wall segmented panels as previously described, it is to be understood that this retention system may be employed in other types of combustor liner configurations or components of the engine. For example, such an improvement may be utilized in the transition duct leading the combustion products from the can burners to the turbine inlet.

Figure 2:
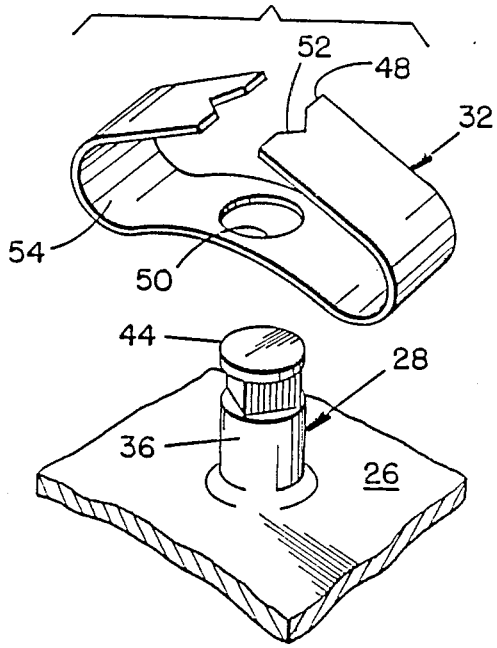
FIG. 2 is a detail perspective exploded view illustrating the components of the invention.
Figure 3:
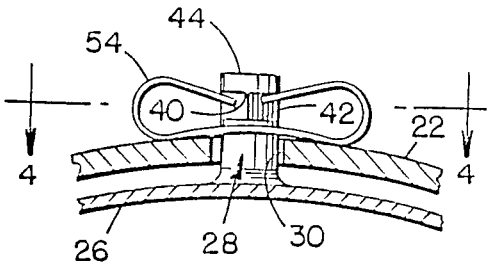
FIG. 3 is a detail side elevation view illustrating the improved attachment device of the invention, certain parts being cut away and shown in section.
Figure 1:
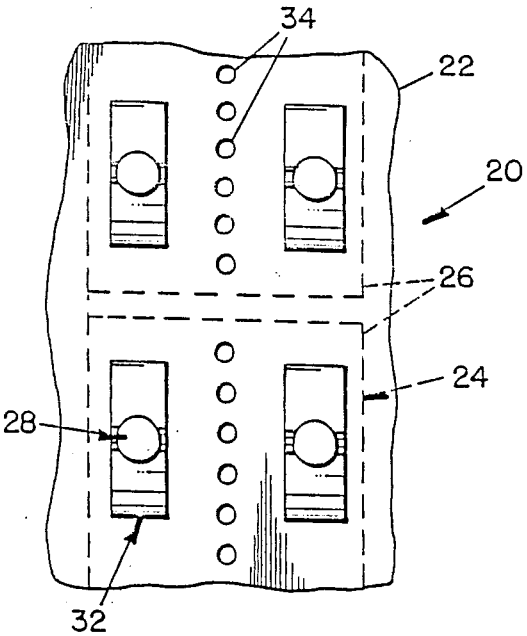
FIG. 1 is a partial plan view of the shell and floating wall panel with the improved attachment device of the invention.

As noted from FIGS. 1-3, the combustor 20 (only partially shown) comprises an outer shell generally indicated by reference numeral 22 and an inner liner generally indicated by reference numeral 24. The inner liner 24 defining the flow path of the engine's working medium consists of a plurality of segments 26 spaced around the circumference of the shell and extending axially along the flow path. Each segment 26 carries at least one integral post 28 that is adapted to extend radially through apertures 30 formed in the shell 22.

An elongated clip 32 is cooperatively engaged with each post 28 in a manner to be described and in a direction specifically related to cooling air holes 34 formed in the outer shell 22. In the instance illustrated in FIG. 1, each clip 32 is positioned generally parallel to the row of cooling air holes 34. An important consideration of the invention is the fact that the relationship between each clip 32 and its associated post 28 is such that when they are assembled, the clip does not rotate and obstruct these cooling air holes 34.

Figure 4:
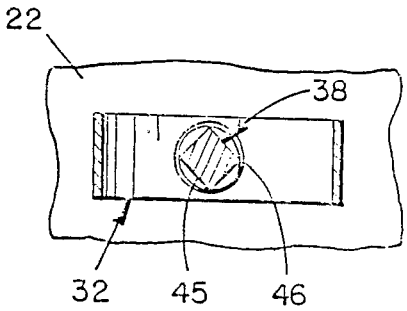
FIG. 4 is a cross section view taken along line 4—4 in FIG. 3.

As best illustrated, in FIGS. 2 and 4, each post 28 is formed to have a generally round cross section and a peripheral outer surface 36. The post 28 is uniquely formed with a square cross section region 38 defined between opposed shoulders 40, 42 (FIG. 3) at a location spaced from an extreme end 44 thereof. The region 38 defines sidewalls 45 lying in a chordal plane and corner edges 46 at the intersection of each pair of the sidewalls. The edges 46 are substantially coextensive with the outer surface 36, although, for ease of manufacture or other reasons, they may be spaced radially inwardly from the outer surface.

Figure 5:
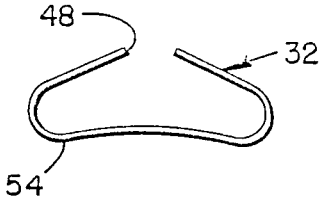
FIGS. 5 and 6 are side elevation and top plan views, respectively, of one component of the invention.
Figure 6:
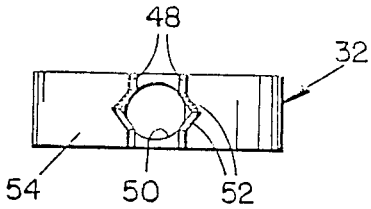

As previously noted, an elongated clip 32 is operatively associated with each of the posts 28. As seen especially well in FIGS. 5 and 6, each clip 32 is composed of a spring sheet material, such as spring steel, having opposed ends 48 and a centrally disposed hole 50 generally equidistant from the ends for reception on the post 28. The ends 48 are formed with diamond shaped cutouts 52 so as to conform with the sidewalls 45 and their associated corner edge 46. As seen particularly well in FIG. 6, the ends 48 are proximally opposed to one another so as to generally overlie the hole 50. This construction enables the cutouts 52 to engage the sidewalls 45 and their associated corner edges 46 when the clip is received on the post 28, hole 50 having a greater diameter than that of the post. Opposed loop portions 54 are thereby defined on opposite sides of the whole and, when the clip is engageably received on the post 28, the loop portions 54 are engageable with the outer shell 22.

It will be appreciated that the orientation of the region 38 and of the cutouts 52 is such that when a clip 32 is in its fastened condition, it does not interfere with the cooling air holes 34 as seen in FIG. 1. Thus, the mutually cooperable region 38 and cutouts 52 serve to orient the clip and prevent rotation thereof. Additionally, the inner face of each loop 54 urges the inner liner 24 toward the outer shell 22. This radially loads the shell and panel toward each other, while allowing circumferential and axial movement relative to each other, so as to minimize chattering and hence preventing any acoustical problems that might otherwise occur and minimizing cycofatigue problems.

As is apparent from the foregoing and inasmuch as the clip completely encircles the post 28, the clip is unable to slip off and hence cannot become dislodged, an intolerable situation, to avoid the possibility of it being ingested in the engines turbine. The retaining force of each loop portion 54 can be adjusted by changing the radius of curvature thereof and also by suitably removing some appropriate amount of material in the loop 54.

While in certain installations it may be possible to assemble the clip by hand, in others it may necessary to use a mounting tool. Such a tool could be a common pliers. The clip 32 is simply positioned such that the hole 50 overlies the end 44 of the post 28. With one leg of the pliers engaged with one end 48 and the other leg engaged with the opposite end, then forcing the pliers radially in the direction of the outer shell 22, the ends 48 are caused to snap into position beneath the shoulder 40 on the post 28.

While a preferred embodiment of the invention has been disclosed in detail, it should be understood by those skilled in the art that various modifications may be made to the illustrated embodiment without departing from the scope thereof as described in the specification and defined in the appended claims. For example, although the region 38 has been described as being square in cross section, it may be of any polygonal shape and the cutouts 52 would be modified accordingly.

What is claimed is:

1. For use with a combustor for a gas turbine engine having an outer shell and an inner segmented free floating member conforming to the shape of the outer shell defining a combustion section, the segmented members being movable circumferentially and axially relative to the outer shell in response to the combustion products, fastener means for securing the segmented members to the outer shell comprising:

at least one post integral with each of the segmented members extending radially through an opening in the shell, said post generally having a round cross section and a peripheral outer surface and formed with a square cross section region defined between opposed shoulders at a location spaced from an extreme end thereof, said square cross section region defining four sidewalls lying in a chordal plane and corner edges at the intersection of each pair of said sidewalls being substantially coextensive with the outer surface of said post;

an elongated clip composed of spring sheet material having opposed ends and a centrally disposed hole therein equidistant from said ends for reception on said post, said ends formed with diamond shaped cutouts to conform with a mating pair of said sidewalls and their associated one of said corner edges, said ends being proximally opposed to one another so as to generally overlie the hole in said clip to enable said cutouts to engage said mating pair of said sidewalls and their associated one of said corner edges, said clip thereby having opposed loop portions on opposite sides of the hole engageable with the outer shell;

whereby when said clip is received on said post and said cutouts engage said mating sidewalls and said associated corner edge, said clip retains and biases the segmented member and the shell together, said clip being oriented in a given position and being incapable of becoming dislodged by relative axial movement of the segmented member and the shell.

2. A fastener as set forth in claim 1 wherein the material of which said clip is composed is spring steel.

3. For use with a combustor for a gas turbine engine having an outer shell and an inner segmented free floating member conforming to the shape of the outer shell defining a combustion section, the segmented members being movable circumferentially and axially relative to the outer shell in response to the combustion products, fastener means for securing the segmented members to the outer shell comprising:

at least one post integral with each of the segmented members extending radially through an opening in the shell, said post generally having a round cross section and a peripheral outer surface and formed with a square cross section region defined between opposed shoulders at a location spaced from an extreme end thereof, said square cross section region defining four sidewalls lying in a chordal plane and corner edges at the intersection of each pair of said sidewalls being substantially coextensive with the outer surface of said post;

an elongated clip composed of spring sheet material having a hole therein for reception on said post and an end distant therefrom formed with a diamond shaped cutout to conform with a mating pair of said sidewalls and their associated one of said corner edges, said end generally overlying the hole in said clip to enable said cutout to engage said mating pair of said sidewalls and their associated one of said corner edges, said clip thereby having a loop portion adjacent the hole and engageable with the outer shell;

whereby when said clip is received on said post and said cutout engages said mating sidewalls and said associated corner edge, said clip retains and biases the segmented member and the shell together, said clip being oriented in a given position and being incapable of becoming dislodged by relative axial movement of the segmented member and the shell.

4. A fastener as set forth in claim 1 wherein the material of which said clip is composed is spring steel.

* * * * *